United States Patent [19]

Honma et al.

[11] Patent Number: 4,871,408

[45] Date of Patent: Oct. 3, 1989

[54] IMAGE RECORDING MATERIAL FOR RECORDING IMAGES IN THREE DIMENSIONS AND THREE-DIMENSIONAL IMAGE PROCESSING METHOD USING SAME

[75] Inventors: Shigeo Honma; Sanji Inagaki; Kazuyoshi Hara, all of Osaka, Japan

[73] Assignee: Minolta Camera Kabushiki Kaisha, Osaka, Japan

[21] Appl. No.: 222,817

[22] Filed: Jul. 21, 1988

[30] Foreign Application Priority Data

Jul. 29, 1987 [JP] Japan ..... 62-115125[U]
Feb. 24, 1988 [JP] Japan ..... 63-22450[U]

[51] Int. Cl.[4] ..... B41M 5/00

[52] U.S. Cl. ..... 156/83; 156/219; 156/234; 156/235; 156/240; 156/241; 156/277; 428/195; 428/209; 428/211; 428/215; 428/216; 428/321.5; 428/327; 428/336; 428/345; 428/354; 428/478.2; 428/480; 428/484; 428/500; 428/521; 428/522; 428/532; 428/913; 428/914; 428/537.1

[58] Field of Search ..... 428/195, 321.5, 913, 428/914, 209, 211, 215, 216, 327, 336, 345, 354, 478.2, 480, 484, 500, 521, 522, 532, 537.1; 156/219, 234, 235, 240, 241, 277

[56] References Cited

U.S. PATENT DOCUMENTS 3,088,402 5/1963 Newman ..... 156/83
4,006,267 2/1977 Kurz et al. ..... 427/156

FOREIGN PATENT DOCUMENTS 5935359 12/1977 Japan ..... 156/83
55101954 12/1977 Japan ..... 156/83
5692544 12/1979 Japan ..... 156/83

*Primary Examiner*—Ellis P. Robinson
*Assistant Examiner*—P. R. Schwartz
*Attorney, Agent, or Firm*—Burns, Doane, Swecker & Mathis

[57] ABSTRACT

A three-dimensional image recording material for recording images in three dimensions and a three-dimensional image processing method using the said recording material. In forming the recording material, thermoexpansive microspheres each formed by encapsulating a low boiling, vaporizable substance into a microcapsule of a thermoplastic resin are applied onto sheet together with a binder. In forming a three-dimensional image, a desired image is formed on the thermoexpansive coating layer according to an electrophotographic method and then irradiated with light, whereby the toner image area is heated selectively and so that thermoexpansive coating layer expands to raise the image. Then, a laminate film having a heat transferable coloring material layer is put thereon followed by the application of heat and pressure to color the raised image area in a desired color. By providing a film layer on the thermoexpansive coating layer as the surface layer of the image recording material it is possible to not only improve the adhesion of the coloring material layer of the laminate film but also prevent its adhesion to the other portion than the image area.

20 Claims, 3 Drawing Sheets

IMAGE RECORDING MATERIAL FOR RECORDING IMAGES IN THREE DIMENSIONS AND THREE-DIMENSIONAL IMAGE PROCESSING METHOD USING SAME

BACKGROUND OF THE INVENTION

The present invention relates to an image recording material capable of recording images raised from sheet and having cubic effect, as well as an image processing method for recording and coloring images in three dimensions using the said recording material.

For forming images having cubic effect on sheet there have widely been used physical methods such as, for example, pressing sheet using a matrix. In addition, there has recently been adopted a method using a thermoexpansive sheet P which, as shown in sectional construction in FIG. 1, comprises a base sheet 1 and a coating layer 2 formed thereon, the coating layer 2 containing thermoexpansive microspheres 3 of a low boiling, vaporizable material each encapsulated in a thermoplastic resin microcapsule (see Japanese Examined patent publication No. 35359/84 and Japanese Laid-Open patent publication No. 101954/80).

For forming a three-dimensional image using the aforesaid thermoexpansive sheet, first a desired image is formed on the sheet using a material superior in light absorbing characteristic. For example, the image is formed with black toner using a conventional electrophotographic type copying machine. FIG. 2 (*a*) shows a state wherein images 4 have been formed with black toner on the coating layer 2 of the thermoexpansive sheet P. Then, the surface of the sheet P is irradiated with light, with the result that only the image portions 4 formed with black toner are heated selectively due to the difference in light absorbing characteristic, thereby causing the thermoexpansive microspheres 3 to expand. Consequently, the image portions are raised from the sheet surface to form images having cubic effect as shown in FIG. 2 (*b*).

Heretofore, a thermoexpansive sheet having three-dimensional images formed thereon has mainly been used as a braille sheet for visually handicapped people. In this case, a single color (black) was sufficient. On the other hand, sheets having three-dimensional images formed thereon are expected to be used as advertisement media, picture books and in various other applications. In this case, it is necessary that the three-dimensional images be colored and made large in area. If a color toner is used in the image forming process, however, since the color toner is lower in light absorbing efficiency than black toner, it does not generate heat sufficient to fully expand the thermoexpansive spheres on the sheet, thus making it difficult to form images having cubic effect.

To solve this problem there has been proposed a method wherein images are formed with black toner and raised by light irradiation, then a laminate film having a heat-transferable coloring material layer is pressure-bonded under heating to the sheet having the images thereon and thereby transferred to the raised toner images. According to this method, however, the toner image surfaces are cracked when raised and so become rough, resulting in that not only it is no longer possible to effect uniform transfer of the coloring material layer but also, since the coating layer is basically a thermoplastic resin, it easily bonds to an adhesive layer of the laminate film so there is fear of the coloring material layer also adhering to the other sheet surface portion than the toner image area and thereby staining the sheet surface.

SUMMARY OF THE INVENTION

It is a principal object of the present invention to provide a novel image recording material for the formation of three-dimensional images each having a smooth surface.

It is another object of the present invention to provide a novel image recording material for the formation of three-dimensional images which material permits desired coloring for the image surfaces.

It is a further object of the present invention to provide an image processing method for recording images in three dimensions and coloring them in desired colors, using the above image recording material.

The above and other objects and features of the invention will appear more fully hereinafter from a consideration of the following description taken in connection with the accompanying drawing wherein one example is illustrated by way of example.

DETAILED DESCRIPTION OF THE PREFERRED EMBODIMENTS

An embodiment of the present invention will be described hereinunder.

Figure 1:
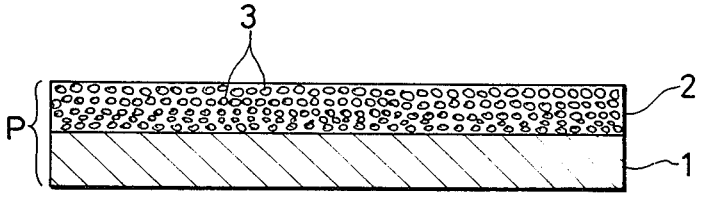
FIG. 1 is an enlarged sectional view showing the construction of a conventional thermoexpansive sheet.
Figure 2A:
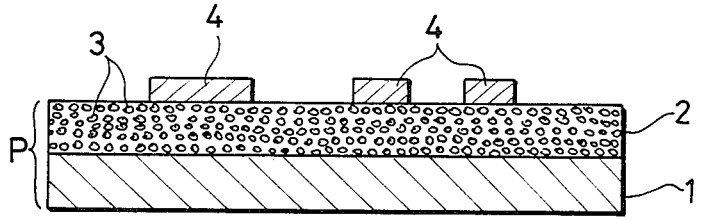
FIGS. 2 (*a*) and (*b*) are explanatory views of three-dimensional image processing steps using the conventional thermoexpansive sheet shown in FIG. 1.
Figure 2B:
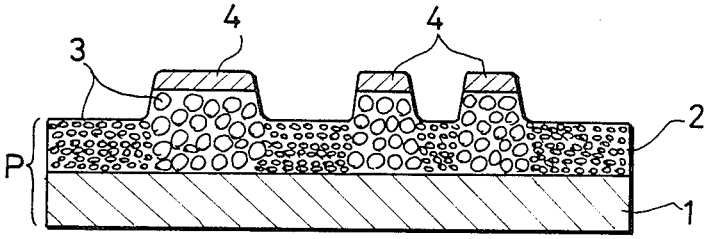
Figure 3:
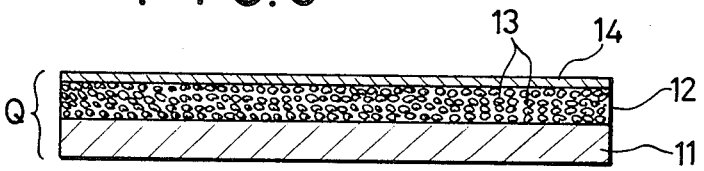
FIG. 3 is an enlarged sectional view showing the construction of an image recording material embodying the present invention.
Figure 4A:
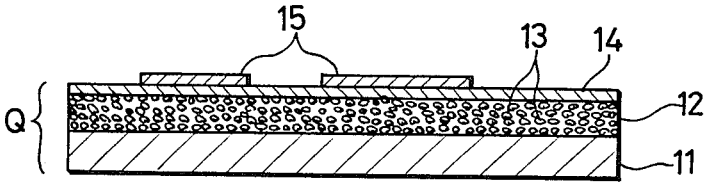
FIGS. 4 (*a*), (*b*), (*c*) and (*d*) are explanatory views of three-dimensional image processing steps using the image recording material shown in FIG. 3.
Figure 4B:
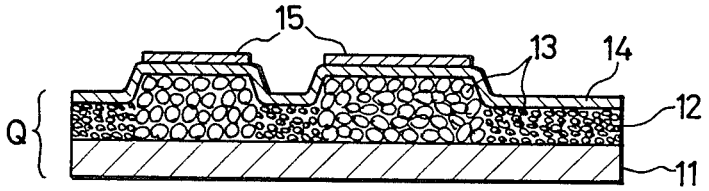
Figure 4C:
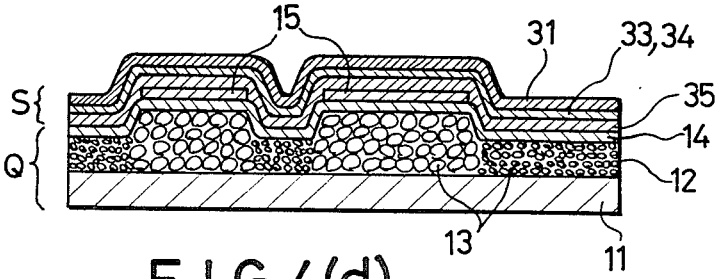
Figure 4D:
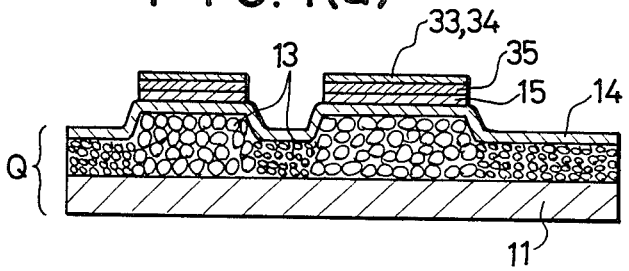

FIG. 3 is a sectional view explaining the construction of a three-dimensional image recording material Q, wherein the thickness of each layer is shown on a larger scale. In the same FIGURE, the reference numeral 11 denotes a base sheet formed of a material having rigidity sufficient to prevent expansion of the back side of the base sheet when later-described thermoexpansive microspheres expand on heating, and which material does not soften at a temperature at which the The present invention relates to an image recording material for recording an image in three dimensions suitable for use in a three-dimensional image forming method wherein a toner image of an original is formed on the recording material according to an electrophotographic method and heat is applied selectively to the image area formed by the toner to raise the image area, the image recording material comprising:

a sheet-like base material;

a thermoexpansive coating layer formed by application on the base material, said coating layer containing microspheres constructed to expand upon application of heat and a binder for bonding to the base material in a dispersed condition of the microspheres in the coating; and a film layer formed on the upper surface of said thermoexpansive coating layer.

The present invention also relates to an image processing method for recording an image on a recording material in three dimensions and coloring the image, which method comprises the steps of:

providing a recording material, said recording material comprising a base material, a thermoexpansive coating layer provided on the base material and consisting of thermoexpansive microspheres and a binder for the microspheres, and a film layer formed on the thermoexpansive coating layer;

forming a toner image of an original on said recording material;

applying heat selectively to the toner image area formed on said recording material, whereby the toner image-existing area is raised to effect a three-dimensional image recording;

putting a laminate film having a coloring material layer of a desired color onto the recording material which has been subjected to said three-dimensional image forming step, followed by application of heat and pressure, the laminate film having a heat- and pressure-sensitive adhesive layer on its face in contact with the recording material; and peeling said laminate film from the recording material, whereby the image now three-dimensional is colored in the desired color.

An embodiment of the present invention will be described hereinunder.

FIG. 3 is a sectional view explaining the construction of a three-dimensional image recording material Q, wherein the thickness of each layer is shown on a larger scale. In the same FIGURE, the reference numeral 11 denotes a base sheet formed of a material having rigidity sufficient to prevent expansion of the back side of the base sheet when later-described thermoexpansive microspheres expand on heating, and which material does not soften at a temperature at which the said microspheres expand. Examples of such material include paper, synthetic paper, synthetic resin sheet, plywood and metal foil.

Numeral 12 denotes a thermoexpansive coating layer formed by applying thermoexpansive microspheres 13 of 5 to 30$\mu$ in particle diameter onto the base sheet 11 together with a binder of a thermoplastic resin such as, for example, vinyl acetate resin, acrylic acid ester resin, methacrylic acid ester resin, or styrene-butadiene resin, followed by drying. The thermoexpansive microspheres 13 are each formed by encapsulating propane, butane or any other low boiling, vaporizable substance into a microcapsule of a thermoplastic resin such as vinylidene chloride—acrylonitrile copolymer, methacrylic acid ester—acrylonitrile copolymer, or vinylidene chloride—acrylic acid ester copolymer. As the thermoexpansive microsphere there also may be used a granular, heat-sensitive, organic foaming agent such as azobisisobutyronitrile.

Numeral 14 denotes a film layer formed of a material which has heat resistance capable of resisting heat generated from image portions upon light irradiation or heat generated at the time of coloring the image portions using a laminate film having a heat-transferable coloring material layer and which material permits satisfactory fixation of toner image and is difficult to bond to an adhesive of the said laminate film. The occurrence of crack, etc. is restricted because the expansion in a planar direction of the raised image portions is restricted by the film layer 14. As the material of the film layer 14 there is used one or a mixture of two or more selected from cellulose ether resins such as methyl cellulose, ethyl cellulose, propyl cellulose, carboxymethyl cellulose, hydroxyethyl cellulose and hydroxypropylmethyl cellulose, vinyl polymers such as polyvinyl alcohol and polyvinyl pyrrolidone, peptide resins such as casein and gelatin, and starch. These materials are water-soluble resins, so where water resistance is required, there may be used a suitable crosslinking agent.

To form the film layer 14 on the thermoexpansive coating layer 12, an aqueous solution of the material resin is applied onto the coating layer 12 followed by drying, whereby there can be formed a film layer having a thickness of 0.1 to 5 $\mu$m.

Three-dimensional images are formed and colored in the following manner. Explanation will be given below with reference to FIG. 4 about an example of coloring three-dimensional images using a laminate film.

Original images are transferred onto the film 14 formed on the thermoexpansive coating layer 12 of the three-dimensional image recording material (hereinafter referred to simply as the "sheet") Q using a black toner (or a deep color toner) comprising a thermoplastic resin such as styrene-acrylic acid ester or polyester and carbon black, by means of a conventional electrophotographic type copying machine. FIG. 4 (*a*) shows the section of the sheet Q with toner images 15 formed thereon.

Figure 5:
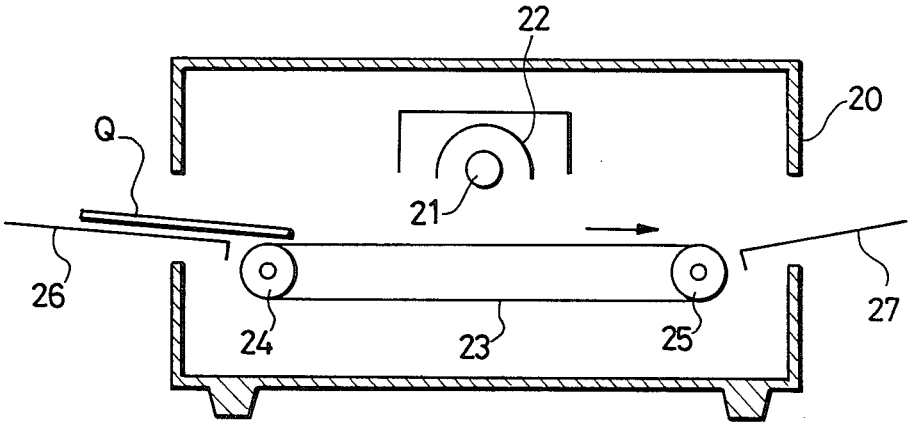
FIG. 5 is a sectional view showing a main construction of a light irradiator.

Next, the sheet is irradiated with light. An example of a light irradiator is shown in FIG. 5. In a housing 20, there is provided an illuminant lamp 21 such as a halogen lamp in an upper position below a reflecting mirror 22. Below the illuminant lamp 21, there is disposed a conveyor belt 23 formed of a metal or any other heat-resistant material, which is stretched between a driving pulley 24 and a driven pulley 25 and is moved in the direction of arrow by means of a drive source (not shown). Numerals 26 and 27 denote a paper feed tray and a paper discharge tray, respectively.

The conveyor belt 23 is started to move by applying power and the illuminant lamp 21 is turned ON. Then, the sheet Q is advanced so that the thermoexpansive coating layer 12 with the toner images 15 formed thereon is opposed to the illuminant lamp 21. The sheet Q is irradiated with light under the lamp 21, whereupon the images 15 formed by the black toner absorb light energy and are heated thereby, so that the thermoexpansive coating layer 12 underlying the toner images 15 is heated. As a result, the microspheres 13 in this area expand rapidly to raise the corresponding portions of the coating layer 12. FIG. 4 (*b*) shows the section of the sheet Q after completion of the irradiation. In this case, since the expansion in a planar direction of the raised portions is restricted by the film layer 14, the toner images 15 formed thereon will not be cracked or damaged.

Next, to color the surfaces of the raised three-dimensional images in a desired color, the surfaces of the three-dimensional black toner images are coated with a laminate film.

Figure 6:
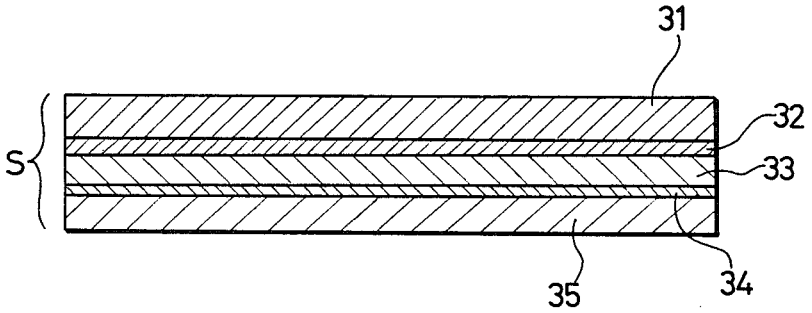
FIG. 6 is an enlarged sectional view showing the construction of a laminate film having a transferable coloring material layer.

The laminate film, indicated by S, is of such a layer construction as shown in FIG. 6, for example. In the same FIGURE, the numeral 31 denotes a base film which is a polyester film having a thickness of 5 to 30$\mu$;

numeral 32 denotes a release layer formed by a wax-based resin about 0.02μ in thickness; and numeral 33 denotes a coloring material layer formed by mixing resin, solvent and dye or pigment into a desired color. Numeral 34 denotes a thin aluminum film layer about 0.04 μ in thickness formed by depositing high purity aluminum on the coloring material layer 33 by a vacuum deposition method, and numeral 35 denotes an adhesive layer about 2μ in thickness formed by a heat- and pressure-sensitive adhesive which exhibits good adhesion for fixed toner. The thin aluminum film layer 34 is formed only when a metallic color film is to be formed. It is not required for other color films.

The coating operation using the laminate film S is performed in the following manner. First, the surface of the adhesive layer 35 of the laminate film S having the desired color is put on the toner images 15 side of the sheet Q, then both are pressure-bonded together under heating by being passed between known heat rollers, whereby the adhesive layer 35 of the laminate film S firmly bonds to the fixed toner forming the toner images 15 [see FIG. 4 (*c*)]. In this case, the adhesive layer 35 does not bond to the film 14 on the sheet 11. Upon removal of the base film 31 of the laminate film S from the sheet Q there remains the coloring material layer 33 (and 34) of the laminate film S on only the toner images 15 in a bonded condition [see FIG. 4 (*d*)].

In the three-dimensional image forming sheet of the present invention, the thermoexpansive coating layer is coated with a film which exhibits good adhesion for molten toner, so even when the thermoexpansive coating layer portions corresponding to the toner image portions are raised upon irradiation of light, the toner image surfaces are maintained smooth and the adhesion of toner is good, thus permitting uniform transfer of the coloring material layer of the laminate film. Further, since the coloring material of the laminate sheet is difficult to adhere to the film surface portion where toner image is not formed, there is no fear of stain of the sheet surface.

Having described a specific embodiment of our bearing, it is believed obvious that modification and variation of our invention is possible in light of the above teachings.

What is claimed is:

1. An image recording material for recording an image in three dimensions suitable for use in a three-dimensional image forming method wherein a toner image of an original is formed on the recording material according to an electrophotographic method and heat is applied selectively to the image area formed by the toner to raise the image area, said image recording material comprising:

a sheet of base material;

a thermoexpansive coating layer formed by application on the base material, said thermoexpansive coating layer comprising thermoexpansive microspheres and a binder for bonding to the base material, said microspheres being dispersed in said binder; and a film layer formed on the upper surface of said thermoexpansive coating layer said film layer comprising a material having a heat resistance capable of resisting heat generated from said image area by light irradiation or heat generated at the time of coloring said image area using a laminate film having a heat transferable coloring material layer; wherein said film layer material permits substantial fixation of said toner image thereto and substantially prevents bonding thereto by an adhesive of said laminate film; and wherein said film layer is substantially void of cracks when expanded in a planar direction of the raised image area.

2. A three-dimensional image recording material according to claim 1, wherein said film layer is at least one member selected from the group consisting of methyl cellulose, ethyl cellulose, propyl cellulose, carboxymethyl cellulose, hydroxyethyl cellulose, hydroxypropylmethyl cellulose, polyvinyl alcohol, polyvinyl pyrrolidone, casein, gelatin, and starch.

3. A three-dimensional image recording material according to claim 2, wherein said film layer further comprises a crosslinking agent.

4. A three-dimensional image recording material according to claim 1, wherein said film layer is formed by applying an aqueous solution of at least one member selected from the group consisting of methyl cellulose, ethyl cellulose, propyl cellulose, carboxymethyl cellulose, hydroxyethyl cellulose, hydroxypropylmethyl cellulose, polyvinyl alcohol, polyvinyl pyrrolidone, casein, gelatin, and starch onto said thermoexpansive coating layer followed by drying.

5. A three-dimensional image recording material according to claim 1, wherein said base material is a member selected from the group consisting of paper, synthetic paper, synthetic resin sheet, plywood and metal foil.

6. A three-dimensional image recording material according to claim 1, wherein said binder comprises a thermoplastic binder resin.

7. A three-dimensional image recording material according to claim 6, wherein said thermoplastic binder resin is a member selected from the group consisting of vinyl acetate, acrylic acid ester, methacrylic acid ester and styrene-butadiene.

8. A three-dimensional image recording material according to claim 1, wherein said thermoexpansive microspheres are formed by encapsulating a low boiling, vaporizable substance into a microcapsule of a thermoplastic resin.

9. A three-dimensional image recording material according to claim 8, wherein said vaporizable substance comprises propane or butane.

10. A three-dimensional image recording material according to claim 8, wherein said thermoplastic microcapsule resin is a member selected from the group consisting of vinylidene chloride-acrylonitrile copolymer, methacrylic acid ester-acrylonitrile copolymer and vinylidene chloride-acrylic acid ester copolymer.

11. A three-dimensional image recording material according to claim 1, wherein said thermoexpansive microspheres comprise a granular, heat-sensitive, organic foaming agent.

12. A three-dimensional image recording material according to claim 11, wherein said foaming agent comprises azobisisobutyronitrile.

13. A three-dimensional image recording material according to claim 1, wherein said film layer has a thickness of from 0.01 to 5 microns.

14. A three-dimensional image recording material according to claim 1, wherein said thermoexpansive microspheres comprise a particle diameter of from 5 to 30 microns.

15. An image processing method for recording an image on a recording material in three dimensions and coloring the image, which method comprises the steps of:

providing a recording material, said recording material comprising a base material, a thermoexpansive coating layer provided on the base material, said thermoexpansive coating layer comprising thermoexpansive microspheres and a binder for the microspheres, and a film layer formed on the thermoexpansive coating layer;

forming a toner image of an original on said film layer of said recording material;

applying heat selectively to the toner image area formed on said recording material, whereby the toner image-existing area is raised to effect a three-dimensional image recording;

thereafter applying to said film layer of said recording material a laminate film comprising a coloring material layer of a desired color bonded to a heat- and pressure-sensitive adhesive layer whereby said adhesive layer contacts said film layer of said recording material followed by the application of heat and pressure whereby said adhesive layer bonds to said toner image and does not bond to said film layer; and peeling said laminate film from the recording material, whereby the three-dimensional toner image is colored in the desired color.

16. An image processing method according to claim 15, wherein said recording material providing step comprises a step of forming the thermoexpansive coating layer on the base material and a step of applying an aqueous solution of at least one member selected from the group consisting of methyl cellulose, ethyl cellulose, propyl cellulose, carboxymethyl cellulose, hydroxyethyl cellulose, hydroxypropylmethyl cellulose, polyvinyl alcohol, polyvinyl pyrrolidone, casein, gelatin, and starch onto the thermoexpansive coating layer, followed by drying.

17. An image processing method according to claim 15, wherein said step of applying heat selectively comprises irradiating said toner image with light.

18. An image processing method according to claim 15, wherein said laminate film further comprises a base film comprising a polyester film having a thickness of from 5 to 30 microns; a release layer comprising a wax-based resin having a thickness of about 0.02 microns; said coloring material layer comprising a resin, solvent and dye or pigment; and said adhesive layer having a thickness of about 2 microns and comprising a heat-and pressure-sensitive adhesive which exhibits substantial adhesion for a fixed toner.

19. An image processing method according to claim 18, wherein said laminate film further comprises an aluminum film layer having a thickness of about 0.04 microns disposed between said adhesive layer and said coloring layer.

20. An image processing method according to claim 15, wherein said recording material film layer exhibits substantial adhesion to molten toner and substantially no adhesion to said laminate film adhesive layer.

* * * * *